US007721538B2

(12) United States Patent
Koo

(10) Patent No.: US 7,721,538 B2
(45) Date of Patent: May 25, 2010

(54) HYDRAULIC CIRCUIT FOR CONSTRUCTION MACHINE

(75) Inventor: Bon Seok Koo, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 188 days.

(21) Appl. No.: 11/818,549

(22) Filed: Jun. 14, 2007

(65) Prior Publication Data

US 2008/0034748 A1 Feb. 14, 2008

(30) Foreign Application Priority Data

Aug. 11, 2006 (KR) ..... 10-2006-0076296

(51) Int. Cl.
*F15B 11/16* (2006.01)
*E02F 9/22* (2006.01)

(52) U.S. Cl. ..... 60/422; 60/484; 60/486

(58) Field of Classification Search ..... 60/421, 60/422, 484, 486
See application file for complete search history.

(56) References Cited

U.S. PATENT DOCUMENTS 5,083,428 A * 1/1992 Kubomoto et al. ..... 60/421
6,330,797 B1 * 12/2001 Kondo ..... 60/421
6,799,424 B2 * 10/2004 Ioku et al. ..... 60/486
2003/0089106 A1 5/2003 Ioku et al.
2004/0123499 A1 * 7/2004 Arii ..... 37/348
2004/0154294 A1 * 8/2004 Jeon ..... 60/428

FOREIGN PATENT DOCUMENTS

JP 55-103104 8/1980

* cited by examiner

*Primary Examiner*—Thomas E Lazo
(74) *Attorney, Agent, or Firm*—Ladas and Parry LLP

(57) ABSTRACT

A hydraulic circuit for a construction machine is disclosed, which can prevent an energy loss of a hydraulic system by automatically reducing revolution of an engine when a working device such as a boom is not driven. The hydraulic circuit includes first to third hydraulic pumps, a first switching valve, a second switching valve, a third switching valve, a confluence switching valve, a first shuttle valve selecting any one of a pressure of a first signal line in which a signal pressure is formed when the third switching valve for working devices connected to the third hydraulic pump is shifted and a pressure of a second signal line in which a signal pressure is formed when a switching valve for traveling devices is shifted, and a second shuttle valve selecting any one of the pressure selected by the first shuttle valve and a pressure of a third signal line in which a signal pressure is formed when switching valves for the working devices connected to the first and second hydraulic pumps are shifted.

2 Claims, 4 Drawing Sheets

HYDRAULIC CIRCUIT FOR CONSTRUCTION MACHINE

CROSS-REFERENCE TO RELATED APPLICATION

This application is based on and claims priority from Korean Patent Application No. 10-2006-0076296, filed on Aug. 11, 2006 in the Korean Intellectual Property Office, the disclosure of which is incorporated herein in its entirety by reference.

BACKGROUND OF THE INVENTION

1. Field of the Invention

The present invention relates to a hydraulic circuit for a construction machine, which can implement an auto idle function by automatically reducing revolution of an engine when a working device of the construction machine is not driven.

More particularly, the present invention relates to a hydraulic circuit for a construction machine, which can minimize an energy loss of a hydraulic system by automatically reducing revolution of an engine when a working device such as a boom is not driven.

Hereinafter, in the accompanying drawings, only the construction of pilot signal lines related to an auto idle function is illustrated. When corresponding switching valves are switched, the pilot signal lines are intercepted. The switching state of the valves and the connected lines between a main pump and a working device during the switching operation of the corresponding switching valves are not separately illustrated.

2. Description of the Prior Art

Referring to FIG. 1, a conventional hydraulic circuit for a construction machine having an auto idle function includes first, second, and third hydraulic pumps P1, P2, and P3; a first switching valve A composed of valves installed in a flow path of the first hydraulic pump P1 and shifted to control hydraulic fluid fed to working devices (right traveling motor, arm, boom, bucket, and so forth); a second switching valve B composed of valves installed in a flow path of the second hydraulic pump P2 and shifted to control hydraulic fluid fed to working devices (left traveling motor, arm, option device, and so forth); a third switching valve C composed of valves installed in a flow path of the third hydraulic pump P3 and shifted to control hydraulic fluid fed to a swing device and so on; and a confluence switching valve 8 installed on a downstream side of the flow path of the third hydraulic pump P3 and shifted to selectively supply the hydraulic fluid from the third hydraulic pump P3 to the working devices on the first hydraulic pump side P1 or the working devices on the second hydraulic pump side P2, in response to a pilot signal pressure Pi1 applied thereto.

In a general small-sized excavator, the hydraulic fluid fed from the first hydraulic pump P1 is supplied to the right traveling motor and the hydraulic fluid fed from the second hydraulic pump P2 is supplied to the left traveling motor to drive the traveling motors. In the case of driving other working devices (arm, boom, bucket, and so forth), the confluence switching valve 8 is used to supply the hydraulic fluid fed from the third hydraulic pump P3 to the working devices.

The confluence switching valve 8 is shifted, in response to the pilot signal pressure Pi1 applied thereto, to supply the hydraulic fluid fed from the third hydraulic pump P3 to the working devices (arm, boom, bucket, and so forth) on the first hydraulic pump side P1 or to the working devices (arm, boom, option device, and so forth) on the second hydraulic pump side P2.

The pilot signal pressure Pi1 for shifting the confluence switching valve 8 is supplied from a pilot pump (not illustrated) through a first throttling part 1 installed in a pilot signal line 3.

A signal line 4 includes a signal line 5 passing through the switching valves A and B for the working devices and a signal line 6 passing through a switching valve D for traveling devices. In the case where only either the working devices or the traveling devices are shifted to operate, no signal pressure is formed in the pilot signal line 3.

By contrast, in the case where the working devices and the traveling devices are simultaneously shifted to operate, the pilot signal pressure Pi1 is formed in the pilot signal line 3, and the confluence switching valve 8 is shifted in response to the pilot signal pressure Pi1 formed in the pilot signal line 3. Accordingly, the hydraulic fluid fed from the third hydraulic pump P3 is supplied to the working devices (arm, bucket, boom, and so forth) of the first hydraulic pump side P1 or the working devices (arm, boom, option device, and so forth) of the second hydraulic pump side P2.

In the case of simultaneously implementing the above-described confluence circuit and the auto idle function, it is required to provide a signal device that can sense the shifting of the switching valves for the working devices and the switching valves for the traveling devices. Since the pressure is not formed in the pilot signal line 3 when either the switching valves for the working devices or the switching valves for the traveling devices are shifted, the pressure in the pilot signal line 3 cannot be used as an auto idle signal pressure.

That is, in the case of shifting the switching valves for the working devices or the switching valves for the traveling devices, a separate signal line 7 that can sense the shifting is required. The signal line 7 is connected to the signal line for supplying the pilot signal pressure to the confluence switching valve 8 and is connected to a flow path in which a second throttling part 2 is installed. In addition, the signal line 7 is constructed to pass through all the switching valves A, B, C, and D for the working devices and the traveling devices.

Accordingly, in a neutral state of the switching valves A, B, and C connected to the first to third hydraulic pumps P1, P2, and P3, respectively, it is judged that no signal pressure is formed in the signal line 7 and the working devices do not operate, and the engine revolution of the heavy equipment is automatically reduced. In the case of shifting at least one of the switching valves A, B, C, and D, the signal pressure is formed in the signal line 7, and thus the engine revolution can be accelerated by the formed signal pressure.

Referring to FIG. 2, another conventional hydraulic circuit for a construction machine having an auto idle function includes a confluence switching valve 8 that is shifted by a pilot signal pressure Pi1 fed through a third throttling part 11 formed in a pilot signal line 13; a signal line 15 which is connected to the pilot signal line 13 and in which a signal pressure is formed when switching valves A and B for working devices are shifted; a signal line 16 which is connected to the pilot signal line 13 and in which a signal pressure is formed when a switching valve D for working devices is shifted; and a signal line 17 which is connected to a pilot signal pressure Pi2 formed through a fourth throttling part 12 and in which a signal pressure is formed when the switching valves A, B, C, and D for the working devices and the traveling devices connected to first to third hydraulic pumps P1, P2, and P3, respectively, are shifted.

The conventional hydraulic circuit of FIG. 2 further includes the first, second, and third hydraulic pumps P1, P2, and P3; the first switching valve A composed of valves installed in a flow path of the first hydraulic pump P1 and shifted to control hydraulic fluid fed to working devices (right traveling motor, arm, and so forth); the second switching valve B composed of valves installed in a flow path of the second hydraulic pump P2 and shifted to control hydraulic fluid fed to working devices (left traveling motor, boom, and so forth); and the third switching valve C composed of valves installed in a flow path of the third hydraulic pump P3 and shifted to control hydraulic fluid fed to a swing device and so on. However, since these constituent elements are substantially the same as those of the circuit as illustrated in FIG. 1, the detailed description thereof will be omitted. The same drawing reference numerals are used for the same elements across various figures.

As illustrated in FIGS. 1 and 2, the conventional hydraulic circuits having an auto idle function requires a confluence circuit and separate auto idle signal lines, and this causes the construction of the signal lines to be complicated. In particular, the hydraulic circuit as illustrated in FIG. 2 has a very complicated signal lines.

In addition, since the signal line 7 passes through all the switching valves A, B, C, and D of the working devices and the traveling devices, the hydraulic fluid may leak through joint surfaces of the respective switching valves A, B, C, and D. Particularly, in a high-temperature working environment, the formed auto-idle pressure may become unstable due to the leakage of the hydraulic fluid.

SUMMARY OF THE INVENTION

Accordingly, the present invention has been made to solve the above-mentioned problems occurring in the prior art while advantages achieved by the prior art are maintained intact.

One object of the present invention is to provide a hydraulic circuit for a construction machine, which can simplify the construction of signal lines in a hydraulic circuit having a confluence circuit and auto idle signal lines.

The hydraulic circuit for a construction machine according to one embodiment of the present invention can stably maintain the formed auto-idle pressure by minimizing the leakage of hydraulic fluid through joint surfaces of switching valves for working devices and traveling devices.

In order to accomplish these objects, there is provided a hydraulic circuit for a construction machine, according to one aspect of the present invention, which includes first, second, and third hydraulic pumps; a first switching valve composed of valves installed in a flow path of the first hydraulic pump and shifted to control hydraulic fluid fed to a right traveling device and working devices; a second switching valve composed of valves installed in a flow path of the second hydraulic pump and shifted to control hydraulic fluid fed to a left traveling device and working devices; a third switching valve composed of valves installed in a flow path of the third hydraulic pump and shifted to control hydraulic fluid fed to working devices; a confluence switching valve installed on a downstream side of the flow path of the third hydraulic pump and shifted to selectively supply the hydraulic fluid from the third hydraulic pump to the working devices on the first hydraulic pump side or the working devices on the second hydraulic pump side; a first shuttle valve selecting any one of a pressure of a first signal line in which a signal pressure is formed when the third switching valve for the working devices connected to the third hydraulic pump is shifted and a pressure of a second signal line in which a signal pressure is formed when a switching valve for the traveling devices is shifted; and a second shuttle valve selecting any one of the pressure selected by the first shuttle valve and a pressure of a third signal line in which a signal pressure is formed when switching valves for the working devices connected to the first and second hydraulic pumps are shifted.

The hydraulic circuit according to one aspect of the present invention further includes a valve having an inlet that is connected to a flow path connecting the second shuttle valve and the third signal line and an outlet that is connected to a pilot signal line for supplying a pilot signal pressure to the confluence switching valve.

In another aspect of the present invention, there is provided there is provided a hydraulic circuit for a construction machine, which includes first, second, and third hydraulic pumps; a first switching valve composed of valves installed in a flow path of the first hydraulic pump and shifted to control hydraulic fluid fed to a right traveling device and working devices; a second switching valve composed of valves installed in a flow path of the second hydraulic pump and shifted to control hydraulic fluid fed to a left traveling device and working devices; a third switching valve composed of valves installed in a flow path of the third hydraulic pump and shifted to control hydraulic fluid fed to working devices; a confluence switching valve installed on a downstream side of the flow path of the third hydraulic pump and shifted to selectively supply the hydraulic fluid from the third hydraulic pump to the working devices on the first hydraulic pump side or the working devices on the second hydraulic pump side; a first shuttle valve selecting any one of a pressure of a first signal line in which a signal pressure is formed when the third switching valve for the working devices connected to the third hydraulic pump is shifted and a pressure of a third signal line in which a signal pressure is formed when switching valves for the working devices connected to the first and second hydraulic pumps are shifted; and a second shuttle valve selecting any one of the pressure selected by the first shuttle valve and a pressure of a second signal line in which a signal pressure is formed when a switching valve for the traveling devices is shifted.

The hydraulic circuit according to another aspect of the present invention further includes a valve having an inlet that is connected to a flow path connecting the second shuttle valve and the second signal line and an outlet that is connected to a pilot signal line for supplying a pilot signal pressure to the confluence switching valve.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
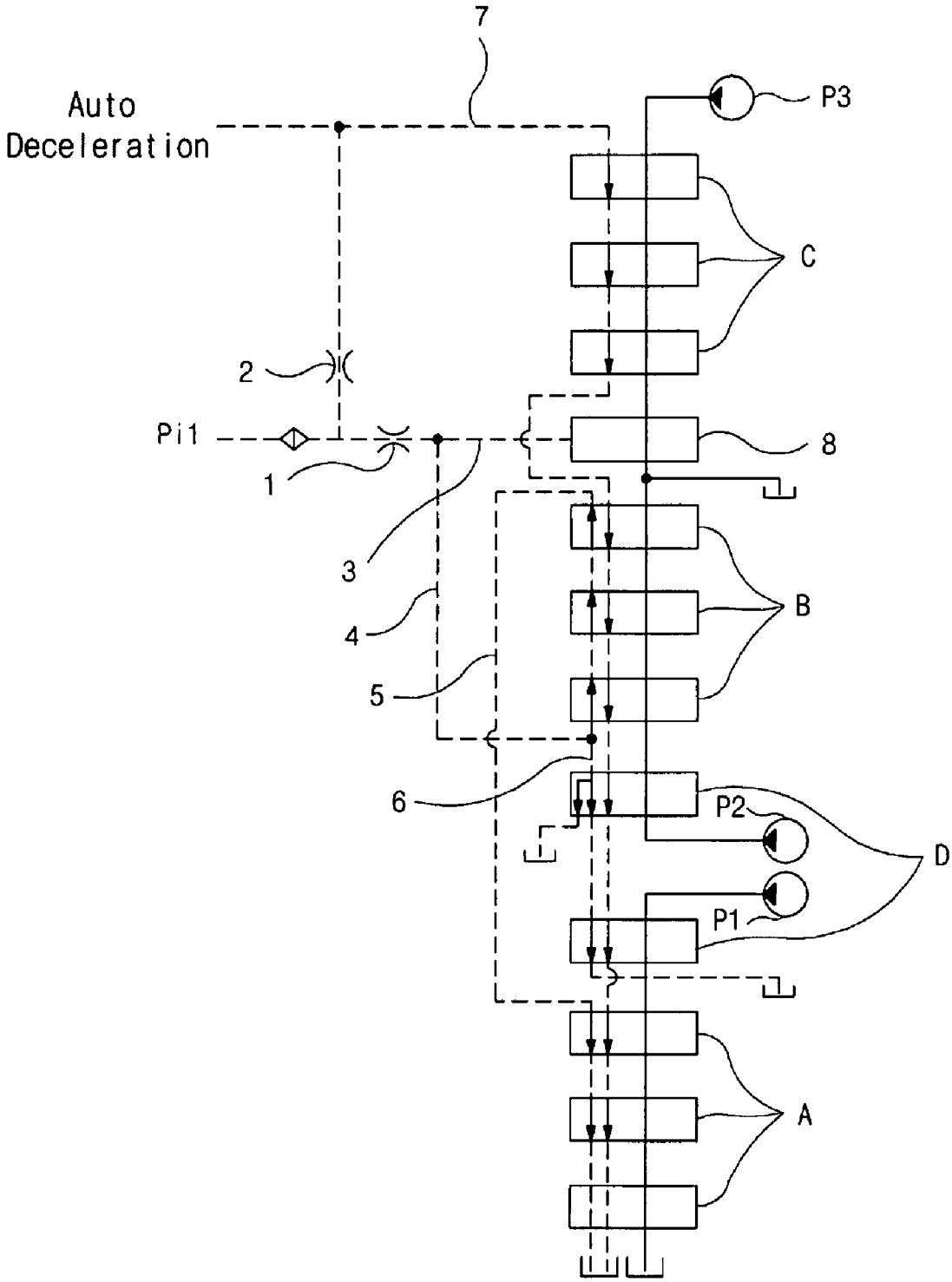
Fig. 1 Prior Art
FIG. 1 is a circuit diagram of a conventional hydraulic circuit having an auto idle function.
Figure 2:
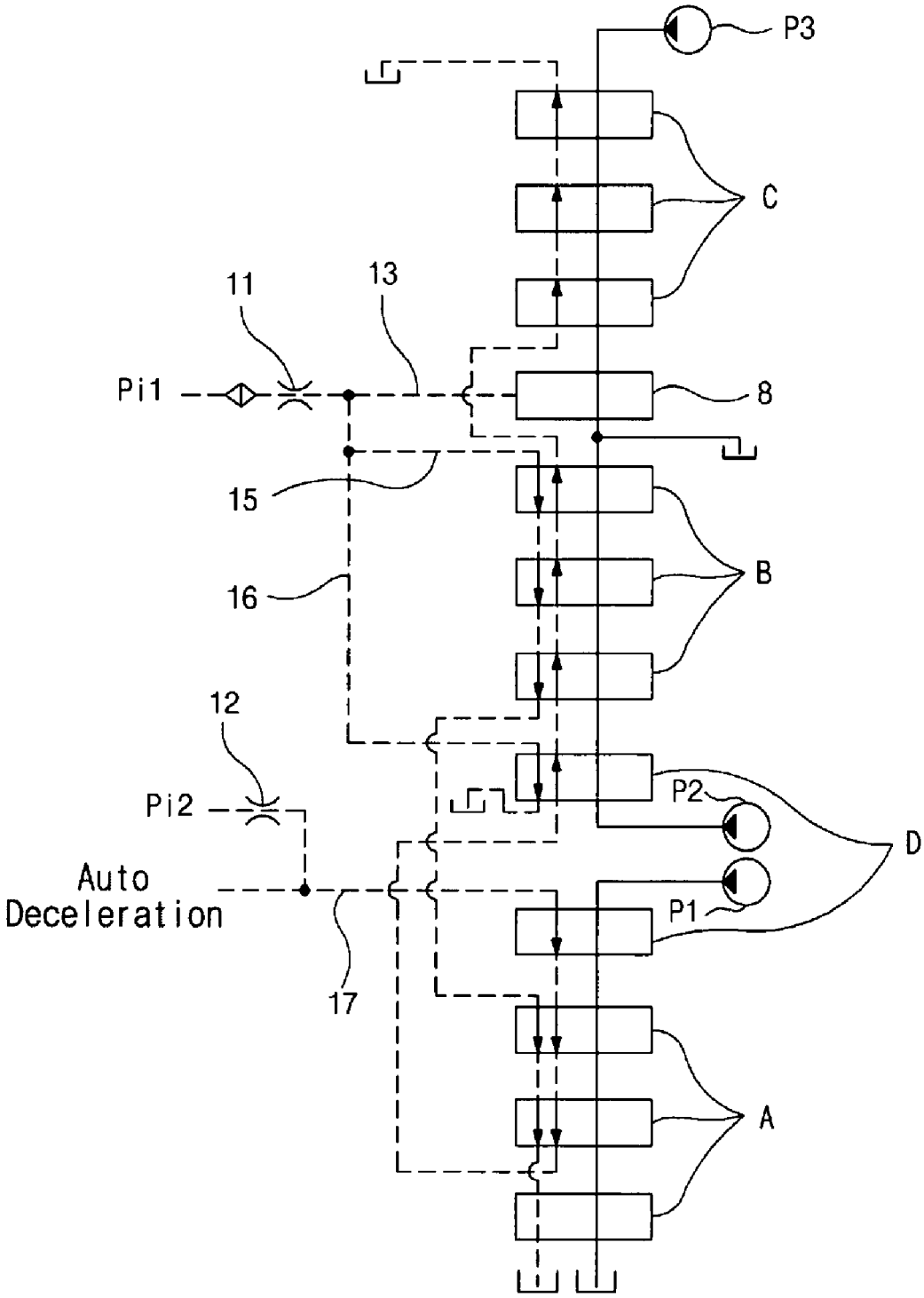
Fig. 2 Prior Art
FIG. 2 is a circuit diagram of another conventional hydraulic circuit having an auto idle function.
Figure 3:
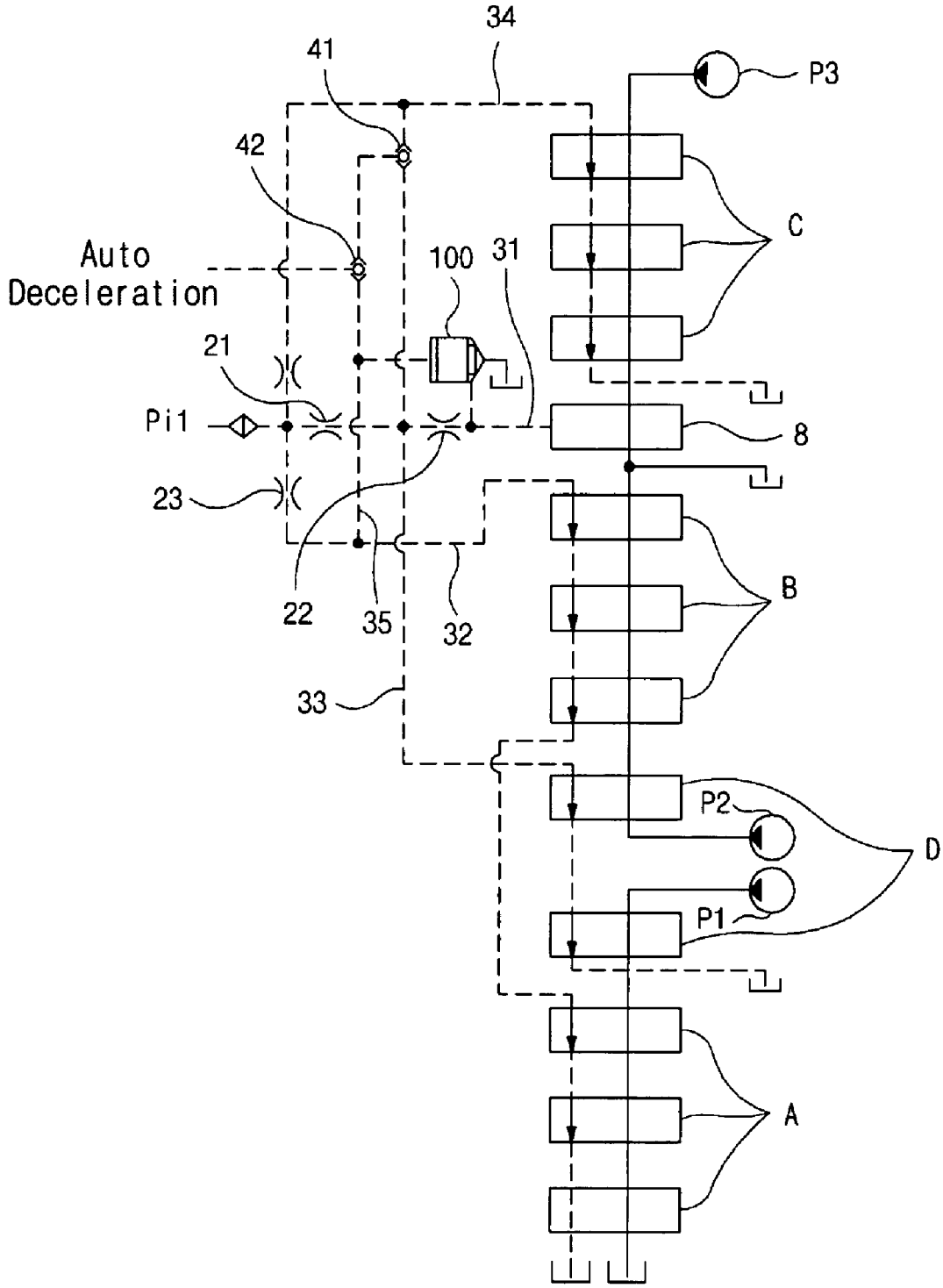
FIG. 3 is a circuit diagram of a hydraulic circuit for a construction machine having an auto idle function according to an embodiment of the present invention.

FIG. 3 is a circuit diagram of a hydraulic circuit for a construction machine having an auto idle function according to an embodiment of the present invention.

Referring to FIG. 3, the hydraulic circuit for a construction machine having an auto idle function according to an embodiment of the present invention includes first, second, and third hydraulic pumps P1, P2, and P3; a first switching valve A composed of valves installed in a flow path of the first hydraulic pump P1 and shifted to control hydraulic fluid fed to a right traveling device and working devices (arm, boom, bucket, and so forth); a second switching valve B composed of valves installed in a flow path of the second hydraulic pump P2 and shifted to control hydraulic fluid fed to a left traveling device and working devices (arm, boom, option device, and so forth); a third switching valve C composed of valves installed in a flow path of the third hydraulic pump P3 and shifted to control hydraulic fluid fed to working devices (swing device and so on); a confluence switching valve 8 installed on a downstream side of the flow path of the third hydraulic pump P3 and shifted to selectively supply the hydraulic fluid from the third hydraulic pump P3 to the working devices on the first hydraulic pump side P1 or the working devices on the second hydraulic pump side P2, in response to a pilot signal pressure Pi1 applied through a pilot signal line 31; a first shuttle valve 41 selecting any one of a pressure of a first signal line 34 in which a signal pressure is formed when the third switching valve C for the working devices connected to the third hydraulic pump P3 is shifted and a pressure of a second signal line 33 in which a signal pressure is formed when a switching valve D for the traveling devices is shifted; and a second shuttle valve 42 selecting any one of the pressure selected by the first shuttle valve 41 and a pressure of a third signal line 32 in which a signal pressure is formed when switching valves A and B for the working devices connected to the first and second hydraulic pumps P1 and P2 are shifted.

The hydraulic circuit according to an embodiment of the present invention further includes a valve 100 having an inlet that is connected to a flow path 35 connecting the second shuttle valve 42 and the third signal line 32 and an outlet that is connected to a pilot signal line 31 for supplying a pilot signal pressure Pi1 to the confluence switching valve 8.

The pilot signal line 31, in which first and second throttling part 21 and 22 are installed, is connected to a flow path for supplying the pilot signal pressure Pi1.

The second signal line 33 is installed to pass through the first throttling part 21 of the pilot signal line 31 and then through the switching valve D for the traveling devices, and is connected to a right end of the valve 100 along with the pilot signal line 31.

The third signal line 32 is installed to pass through a third throttling part 23 and then through the switching valves A and B for the working devices, and is connected to a left end of the valve 100 through the flow path 35.

Hereinafter, the operation of the hydraulic circuit for a construction machine according to an embodiment of the present invention will be described with reference to the accompanying drawings.

As illustrated in FIG. 3, the hydraulic fluid fed from the first hydraulic pump P1 is supplied to the right traveling motor and the hydraulic fluid fed from the second hydraulic pump P2 is supplied to the left traveling motor to drive the traveling motors. In the case of driving other working devices (arm, boom, bucket, and so forth), the confluence switching valve 8 is used to supply the hydraulic fluid fed from the third hydraulic pump P3 to the working devices.

The confluence switching valve 8 is shifted, in response to the pilot signal pressure Pi1 applied thereto through the first and second throttling parts 21 and 22 installed in the pilot signal line 31, to supply the hydraulic fluid fed from the third hydraulic pump P3 to the working devices (arm, boom, bucket, and so forth) on the first hydraulic pump side P1 or to the working devices (arm, boom, option device, and so forth) on the second hydraulic pump side P2.

The pilot signal pressure Pi1 for shifting the confluence switching valve 8 is supplied from a pilot pump (not illustrated) through a first throttling part 1 installed in a pilot signal line 3.

In the case of shifting only the switching valves A and B for the working devices connected to the first and second hydraulic pumps P1 and P2, a signal pressure is formed in the third signal line 32, but no signal pressure is formed in the second signal line 33 connected to the switching valve D for the traveling devices and in the pilot signal line 31 for supplying the pilot signal pressure Pi1 to the confluence switching valve 8. Accordingly, the confluence switching valve 8 is not shifted.

By contrast, in the case of shifting only the switching valve D for the traveling devices connected to the first and second hydraulic pumps P1 and P2, a signal pressure is formed in the second signal line 33 and in the pilot signal line 31, but no signal pressure is formed in the third signal line 32 connected to the switching valves A and B for the working devices.

Accordingly, as a piston inside the valve 100 is moved to the left as illustrated in FIG. 3 and the pilot signal line 31 is connected to a hydraulic tank, no signal pressure is formed in the pilot signal line 31, and thus the confluence switching valve 8 is not shifted.

On the other hand, in the case of simultaneously shifting the switching valve D for the traveling devices and the switching valves A and B for the working devices, the signal pressure is formed in the pilot signal line 31, the third signal line 32, and the second signal line 33, and thus the confluence switching valve 8 is shifted.

Accordingly, the hydraulic fluid fed from the third hydraulic pump P3 is supplied to the working devices (arm, boom, bucket, and so forth) of the first hydraulic pump side P1 or the working devices (arm, boom, option device, and so forth) of the second hydraulic pump side P2 to drive the working devices.

Specifically, the first shuttle valve 41 compares the pressure of the first signal line 34 in which the signal pressure is formed when the third switching valve C for the working devices connected to the third hydraulic pump P3 is shifted with the pressure of the second signal line 33 in which the signal pressure is formed when the switching valve D for the traveling devices is shifted, and selects one of the pressures.

The second shuttle valve 42 compares the pressure selected by the first shuttle valve 41 with the pressure of the third signal line 32 in which the signal pressure is formed when the switching valves A and B for the working devices connected to the first and second hydraulic pumps P1 and P2 are shifted.

Accordingly, the signal pressure is formed in the signal lines 31, 32, 33, and 34 when the switching valves A, B, C, and D connected to the first, second, and third hydraulic pumps P1, P2, and P3, respectively, and the signal pressure is used as an auto idle pressure.

As described above, in the case of forming the confluence circuit and the auto idle signal lines in the hydraulic circuit for a construction machine according to one embodiment of the present invention, a signal line 34 for passing through only the switching valve C of the third hydraulic pump side P3 is separately formed to implement the auto idle function.

The hydraulic circuit as constructed above according to the present invention can minimize the leakage of the hydraulic fluid through the joint surfaces of the respective switching valves in comparison to the conventional hydraulic circuit in which the auto idle signal line passes through all the working devices. Also, the hydraulic circuit according to the present invention can stably maintain the auto idle pressure.

Figure 4:
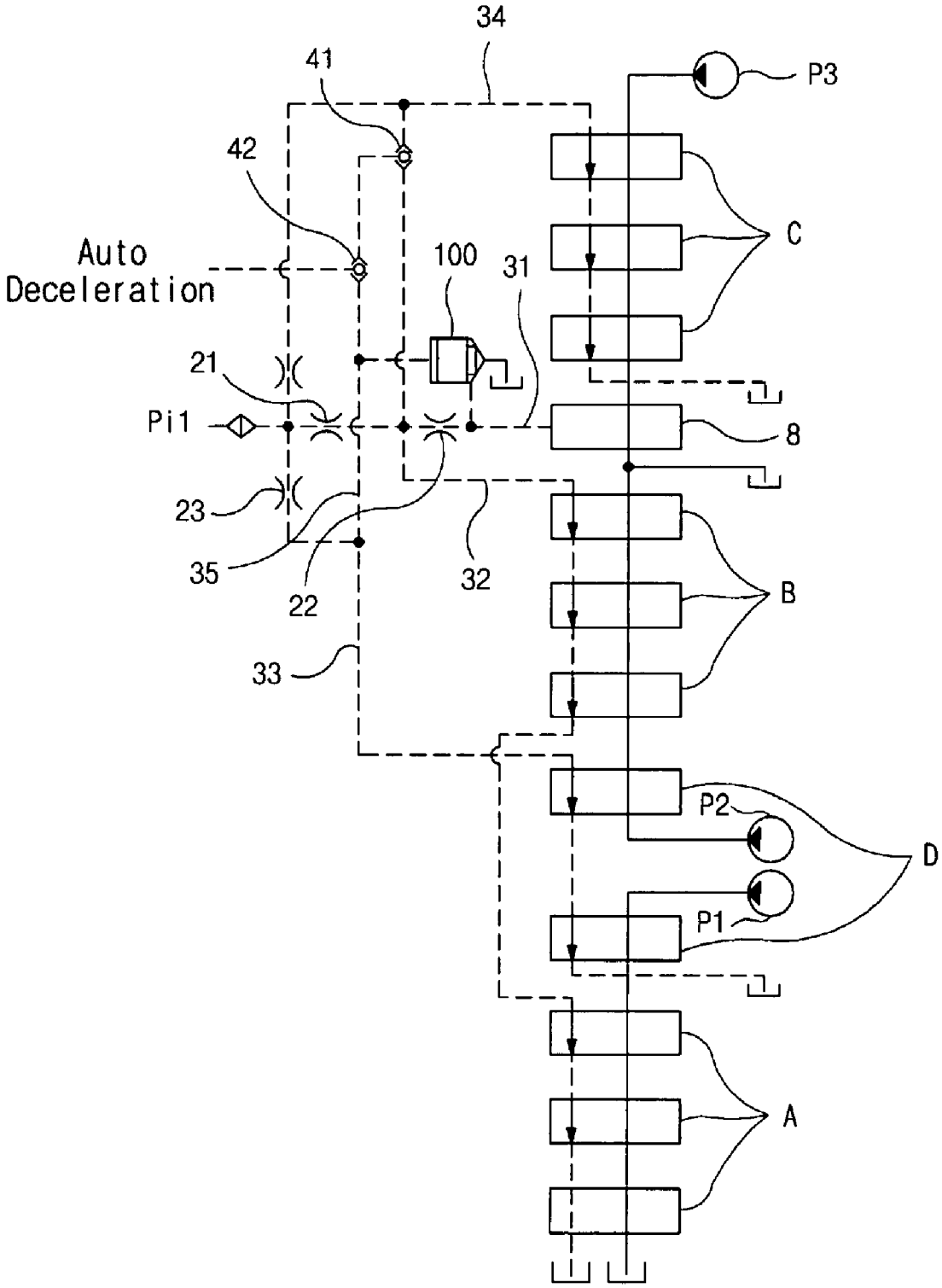
FIG. 4 is a circuit diagram of a hydraulic circuit for a construction machine having an auto idle function according to another embodiment of the present invention.

FIG. 4 is a circuit diagram of a hydraulic circuit for a construction machine having an auto idle function according to another embodiment of the present invention.

Referring to FIG. 4, the hydraulic circuit for a construction machine having an auto idle function according to another embodiment of the present invention includes first, second, and third hydraulic pumps P1, P2, and P3; a first switching valve A composed of valves installed in a flow path of the first hydraulic pump P1 and shifted to control hydraulic fluid fed to a right traveling device and working devices (arm, boom, bucket, and so forth); a second switching valve B composed of valves installed in a flow path of the second hydraulic pump P2 and shifted to control hydraulic fluid fed to a left traveling device and working devices (arm, boom, option device, and so forth); a third switching valve C composed of valves installed in a flow path of the third hydraulic pump P3 and shifted to control hydraulic fluid fed to working devices (swing device and so on); a confluence switching valve 8 installed on a downstream side of the flow path of the third hydraulic pump P3 and shifted to selectively supply the hydraulic fluid from the third hydraulic pump P3 to the working devices on the first hydraulic pump side P1 or the working devices on the second hydraulic pump side P2, in response to a pilot signal pressure Pi1 applied through a pilot signal line 31; a first shuttle valve 41 selecting any one of a pressure of a first signal line 34 in which a signal pressure is formed when the third switching valve C for the working devices connected to the third hydraulic pump P3 is shifted and a pressure of a third signal line 32 in which a signal pressure is formed when switching valves A and B for the working devices connected to the first and second hydraulic pumps P1 and P2 are shifted; and a second shuttle valve 42 selecting any one of the pressure selected by the first shuttle valve 41 and a pressure of a second signal line 33 in which a signal pressure is formed when a switching valve D for the traveling devices is shifted.

The hydraulic circuit according to another embodiment of the present invention further includes a valve 100 having an inlet that is connected to a flow path connecting the second shuttle valve 42 and the third signal line 32 and an outlet that is connected to a pilot signal line 31 for supplying a pilot signal pressure Pi1 to the confluence switching valve 8.

Since the constituent elements, such as the first, second, and third hydraulic pumps P1, P2, and P3, the first switching valve A composed of the valves installed in the flow path of the first hydraulic pump P1 and shifted to control the hydraulic fluid fed to the right traveling device and the working devices (arm, boom, and so forth), the second switching valve B composed of the valves installed in the flow path of the second hydraulic pump P2 and shifted to control the hydraulic fluid fed to the left traveling device and the working devices (boom, option device, and so forth), the third switching valve C composed of the valves installed in the flow path of the third hydraulic pump P3 and shifted to control the hydraulic fluid fed to the working devices (swing device and so on), are substantially the same as those of the circuit as illustrated in FIG. 3, the detailed description thereof will be omitted. The same drawing reference numerals are used for the same elements across various figures.

The first shuttle valve 41 compares the pressure of the first signal line 34 in which the signal pressure is formed when the third switching valve C for the working devices connected to the third hydraulic pump P3 is shifted with the pressure of the third signal line 32 in which the signal pressure is formed when the switching valves A and B for the working devices connected to the first and second hydraulic pumps P1 and P2 are shifted, and selects one of the pressures.

The second shuttle valve 42 compares the pressure selected by the first shuttle valve 41 with the pressure of the second signal line 33 in which the signal pressure is formed when the switching valve D for the traveling devices is shifted, and selects one of the pressures.

Accordingly, the signal pressure is formed in the signal lines 31, 32, 33, and 34 when the switching valves A, B, C, and D connected to the first, second, and third hydraulic pumps P1, P2, and P3, respectively, and the signal pressure is used as the auto idle pressure.

As described above, the hydraulic circuit for a construction machine according to the present invention has the following advantages.

The construction of the signal lines in the hydraulic circuit having the confluence circuit and the auto idle signal lines can be simplified and thus the manufacturing cost can be reduced.

The leakage of the hydraulic fluid through the joint surfaces of the respective switching valves for the working devices and the traveling devices can be minimized, and thus the formed auto idle pressure can be stabilized to heighten the reliability of the hydraulic circuit.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic circuit for a construction machine, comprising:

first, second, and third hydraulic pumps;

a first switching valve composed of valves installed in a flow path of the first hydraulic pump and shifted to control hydraulic fluid fed to a right traveling device and working devices;

a second switching valve composed of valves installed in a flow path of the second hydraulic pump and shifted to control hydraulic fluid fed to a left traveling device and working devices;

a third switching valve composed of valves installed in a flow path of the third hydraulic pump and shifted to control hydraulic fluid fed to working devices;

a confluence switching valve installed on a downstream side of the flow path of the third hydraulic pump and shifted to selectively supply the hydraulic fluid from the third hydraulic pump to the working devices on the first hydraulic pump side or the working devices on the second hydraulic pump side;

a first shuttle valve selecting any one of a pressure of a first signal line in which a signal pressure is formed when the third switching valve for the working devices connected to the third hydraulic pump is shifted and a pressure of a second signal line in which a signal pressure is formed when a switching valve for the traveling devices is shifted;

a second shuttle valve selecting any one of the pressure selected by the first shuttle valve and a pressure of a third signal line in which a signal pressure is formed when switching valves for the working devices connected to the first and second hydraulic pumps are shifted; and a valve having an inlet that is connected to a flow path connecting the second shuttle valve and the third signal line, and an outlet that is connected to a pilot signal line for supplying a pilot signal pressure to the confluence switching valve.

2. A hydraulic circuit for a construction machine, comprising:

first, second, and third hydraulic pumps;

a first switching valve composed of valves installed in a flow path of the first hydraulic pump and shifted to control hydraulic fluid fed to a right traveling device and working devices;

a second switching valve composed of valves installed in a flow path of the second hydraulic pump and shifted to control hydraulic fluid fed to a left traveling device and working devices;

a third switching valve composed of valves installed in a flow path of the third hydraulic pump and shifted to control hydraulic fluid fed to working devices;

a confluence switching valve installed on a downstream side of the flow path of the third hydraulic pump and shifted to selectively supply the hydraulic fluid from the third hydraulic pump to the working devices on the first hydraulic pump side or the working devices on the second hydraulic pump side;

a first shuttle valve selecting any one of a pressure of a first signal line in which a signal pressure is formed when the third switching valve for the working devices connected to the third hydraulic pump is shifted and a pressure of a third signal line in which a signal pressure is formed when switching valves for the working devices connected to the first and second hydraulic pumps are shifted;

a second shuttle valve selecting any one of the pressure selected by the first shuttle valve and a pressure of a second signal line in which a signal pressure is formed when a switching valve for the traveling devices is shifted; and a valve having an inlet that is connected to a flow path connecting the second shuttle valve and the second signal line, and an outlet that is connected to a pilot signal line for supplying a pilot signal pressure to the confluence switching valve.

* * * * *